US011744286B2

(12) United States Patent
Qin et al.

(10) Patent No.: US 11,744,286 B2
(45) Date of Patent: Sep. 5, 2023

(54) ELECTRONIC CIGARETTE (E-CIGARETTE) CAPABLE OF HOLDING, HEATING, AND QUANTITATIVELY SUPPLYING GELLED ELECTRONIC LIQUID (E-LIQUID)

(71) Applicant: CHINA TOBACCO YUNNAN INDUSTRIAL CO., LTD, Kunming (CN)

(72) Inventors: Yunhua Qin, Kunming (CN); Wei Zhao, Kunming (CN); Liu Hong, Kunming (CN); Yi Han, Kunming (CN); Xia Zhang, Kunming (CN); Liu Yang, Kunming (CN); Xiaowei Gong, Kunming (CN); Tinghua Li, Kunming (CN); Shoubo Li, Kunming (CN)

(73) Assignee: CHINA TOBACCO YUNNAN INDUSTRIAL CO., LTD, Kunming (CN)

( * ) Notice: Subject to any disclaimer, the term of this patent is extended or adjusted under 35 U.S.C. 154(b) by 0 days.

(21) Appl. No.: 17/927,707

(22) PCT Filed: Mar. 4, 2021

(86) PCT No.: PCT/CN2021/079137
§ 371 (c)(1),
(2) Date: Nov. 24, 2022

(87) PCT Pub. No.: WO2022/147898
PCT Pub. Date: Jul. 14, 2022

(65) Prior Publication Data

US 2023/0225395 A1 Jul. 20, 2023

(30) Foreign Application Priority Data

Jan. 6, 2021 (CN) ..... 202110013182.6
Jan. 6, 2021 (CN) ..... 202110014458.2

(51) Int. Cl.
*A24F 40/10* (2020.01)
*A24F 40/42* (2020.01)
(Continued)

(52) U.S. Cl.
CPC ..... *A24F 40/10* (2020.01); *A24F 7/02* (2013.01); *A24F 40/42* (2020.01); *A24F 40/46* (2020.01); *A24F 40/60* (2020.01)

(58) Field of Classification Search
CPC ..... A24F 40/10; A24F 40/40; A24F 40/42; A24F 40/46; A24F 7/02
See application file for complete search history.

(56) References Cited

U.S. PATENT DOCUMENTS

2023/0081013 A1* 3/2023 Pilkington ..... A24F 40/42

FOREIGN PATENT DOCUMENTS

CN 207220165 U 4/2018
CN 110495649 A 11/2019
(Continued)

*Primary Examiner* — Hae Moon Hyeon
(74) *Attorney, Agent, or Firm* — Bayramoglu Law Offices LLC

(57) ABSTRACT

An electronic cigarette (e-cigarette) capable of holding, heating, and quantitatively supplying a gelled electronic liquid (e-liquid) is provided. The e-cigarette includes an upper housing, a lower housing, a gel container, a press and reset mechanism, and an aerosol channel. The gelled e-liquid is supplied quantitatively to a heating chamber by manually pressing the press and reset mechanism. The user can adjust the time interval between pressing and releasing the press and reset mechanism according to the needs of the user for each inhalation by adjusting the length of the gelled e-liquid stick supplied to the heating chamber. Besides, a holder is provided therein with heating plates at different positions, and the holder also serves as a heating element. The design avoids the need to provide the heating element
(Continued)

and the heating chamber separately, which reduces the volume of the smoking device.

6 Claims, 5 Drawing Sheets

(51) Int. Cl.

| | |
|---|---|
| ***A24F 40/46*** | (2020.01) |
| ***A24F 7/02*** | (2006.01) |
| ***A24F 40/60*** | (2020.01) |

(56) References Cited

FOREIGN PATENT DOCUMENTS

| | | | | | |
|---|---|---|---|---|---|
| CN | 113412965 | A | * | 9/2021 | |
| KR | 20200085487 | A | | 7/2020 | |
| WO | 2020074595 | A1 | | 4/2020 | |
| WO | WO-2022134312 | A1 | * | 6/2022 | ..... A24F 40/20 |

* cited by examiner

ELECTRONIC CIGARETTE (E-CIGARETTE) CAPABLE OF HOLDING, HEATING, AND QUANTITATIVELY SUPPLYING GELLED ELECTRONIC LIQUID (E-LIQUID)

CROSS REFERENCE TO THE RELATED APPLICATIONS

This application is the national phase entry of International Application No. PCT/CN2021/079137, filed on Mar. 4, 2021, which is based upon and claims priority to Chinese Patent Applications No. 202110014458.2 and No. 202110013182.6, both filed on Jan. 6, 2021, the entire contents of which are incorporated herein by reference.

TECHNICAL FIELD

The present disclosure belongs to the field of electronic cigarettes (e-cigarettes) and in particular to an e-cigarette capable of holding, heating, and quantitatively supplying a gelled electronic liquid (e-liquid).

BACKGROUND

The demand by people for the reduction of harmful effects from cigarettes has promoted the birth and rapid development of e-cigarettes. Nicotine and flavorings are dissolved in glycerol, propylene glycol, or other polyols to make the e-liquid, which serves as the aerosol-producing material of the e-cigarette. The e-liquid is filled into a smoking device and conveyed to an atomizer in the smoking device through e-liquid guide cotton or other guide elements. The e-liquid in the atomizer is heated by an electric heating element to atomize and form an aerosol similar to that of conventional cigarettes for the user to inhale.

However, in actual assembly, the e-liquid container, the e-liquid guide cotton, and the electric heating element of the smoking device may have poor sealing performance due to their inconsistent sizes. In addition, during subsequent storage, transportation, and use, the sealing performance may be impaired due to vibration and collision. As a result, the e-liquid may leak, thereby affecting the user's experience. In order to solve the leakage problem, it has been proposed to replace the e-liquid with a gelled e-liquid as the aerosol-producing material. According to reports, a gelling agent is often used to make the e-liquid solidify into gel (a jelly or a solid). The gelling agent usually has the property of thermo-reversible phase transition, which makes the e-liquid solidify into the gel at a low temperature, liquefied after being heated, and solidified into the gel again after being cooled.

However, new problems arise in the practical use of the gelled e-liquid. If only a small amount of gelled e-liquid pieces are used each time and completely atomized after being heated once, the aerosol produced can only provide several inhalations (such as 7 or 8 inhalations) for the user to continuously take. This cannot meet the user's long-term demand for smoking at any time. Generally, the amount of the e-liquid stored in the e-cigarette must be enough for the user to take hundreds to thousands of inhalations by heating the e-liquid at any time. In addition, in the case of the gelled e-liquid, each inhalation needs a new gelled e-liquid piece, which is troublesome and violates the original intention of using the gelled e-liquid to prevent leakage. When a large gelled e-liquid piece is used, although it is enough for the user to take hundreds to thousands of inhalations after being completely atomized, the following problems will arise.

1) To continuously supply the gelled e-liquid to the heating element as conventional e-cigarettes do, the large gelled e-liquid piece must be heated completely or mostly each time to provide enough e-liquid. Since it is not known in advance how many inhalations the user will take, the amount of the e-liquid stored must at least exceed that required by the user to take 7 or 8 inhalations in a round. After the user stops one round of inhalation, the remaining e-liquid is solidified back to the gelled state and is heated and liquefied again in the next round of inhalation. The repeated heating-cooling (liquefaction-solidification) process consumes the electric energy of the electric heating element and makes the user feel the delay of the first inhalation. The first inhalation requires a large amount of e-liquid to be heated and liquefied to supply enough e-liquid to the heating element through the e-liquid guide cotton. Some chemical substances such as flavorings in the e-liquid may be pyrolyzed due to repeated heating, thereby resulting in a peculiar smell.

2) Although there are many gelling agents that can gel the e-liquid, there are not many gelling agents with the property of thermo-reversible phase transition, which severely narrows the selection materials for gelling agents.

3) If only the desired amount, not all of the gelled e-liquid, is heated and liquefied each time, the gelled e-liquid must be continuously and quantitatively supplied to the heating element. That is, a fixed amount of gelled e-liquid must be supplied to the heating element after the same amount of gelled e-liquid is heated and atomized. However, this is a problem. An e-liquid can be supplied continuously due to its fluidity, but the gelled e-liquid is a jelly or a solid and is not flowable. Therefore, for the gelled e-liquid, how to be supplied quantitatively and continuously has become a big issue. If the gelled e-liquid is supplied to the heating element through the e-liquid guide cotton after being heated and liquefied, only the gelled e-liquid close to the heating element can be liquefied. The gelled e-liquid far away from the heating element cannot be heated and liquefied, so it cannot be supplied to the heating element for atomization, which may cause inhalation interruption and seriously affect the user's experience.

4) The gelled e-liquid may also be dried or oxidized during long-term storage, which will shorten its shelf life and affect inhalation quality. In addition, if the gelling agent used is not vapourable, it will remain in the smoking device after the e-liquid is heated and atomized, thereby contaminating the internal part of the smoking device.

The present disclosure is intended to solve the above problems.

SUMMARY

The present disclosure is proposed to solve most, if not all, of the above problems.

A first aspect of the present disclosure provides an electronic cigarette (e-cigarette) capable of holding, heating, and quantitatively supplying a gelled electronic liquid (e-liquid). The e-cigarette includes an upper housing 1, a lower housing 5, a gel container 2, a press and reset mechanism, and an aerosol channel 6.

An inner wall of the upper housing 1 has an upper end provided with a limit ring 1-3 and a lower end provided with a stop ring 1-4.

The gel container 2 is a hollow cylinder, which has a lower end provided with a hollow holder 2-2, and the holder 2-2 is provided with a gradual extension structure at a connecting position between the holder 2-2 and the gel container 2.

A side wall of the holder 2-2 is longitudinally provided with multiple gaps, which divide the side wall of the holder 2-2 into multiple holding portions 2-2-1. The gradual extension structure of the holder 2-2 is in movable contact with the stop ring 1-4, and the holding portion 2-2-1 forms a heating element.

The press and reset mechanism is connected to the gel container 2 and partially protrudes outside the upper housing 1.

When the press and reset mechanism is not pressed, the stop ring 1-4 is in contact with the holder 2-2 and keeps the holder in a holding state.

When the press and reset mechanism is pressed, the stop ring 1-4 is not in contact with the holder 2-2, and the holder 2-2 is in a releasing state. The releasing state of the holder 2-2 is a natural state.

The stop ring 1-4 and the limit ring 1-3 do not completely fill a gap between the gel container 2 and the upper housing 1. Alternatively, the stop ring 1-4 and the stop ring 1-3 are provided with through holes, such that the gap between the gel container 2 and the upper housing 1 forms a part of the aerosol channel 6.

Preferably, the press and reset mechanism includes a press sleeve 4, a mouthpiece 7, and a reset spring 3. The mouthpiece 7 is inserted into the press sleeve 4 above. The mouthpiece 7 is clamped into the upper housing 1 and protrudes from the upper housing 1. The mouthpiece 7 is connected to the gel container 2 and communicated with the aerosol channel 6.

The reset spring 3 is sleeved outside the gel container 2 and has an upper end abutted against the mouthpiece 7 and a lower end abutted against the limit ring 1-3.

The mouthpiece 7 is fixedly or detachably connected to the gel container 2.

The press sleeve 4 is a hollow cylindrical press sleeve directly covering the mouthpiece 7 or an L-shaped press sleeve covering the mouthpiece 7.

Preferably, the e-cigarette further includes a lower housing 5 provided below the upper housing 1 and detachably connected to the upper housing 1. After heating, if a gelled e-liquid stick 8 leaves powder residue in a smoking device, the lower housing 5 is disassembled from the upper housing 1 to pour out the residue. Of course, if the gelled e-liquid stick 8 is completely atomized without residue, the upper housing 1 and the lower housing 5 can be designed in an integrated way.

Preferably, the smoking device is provided with a control board and a battery.

Preferably, the upper housing 1 includes an upper section 1-1 and a lower section 1-2 that are detachably connected. The limit ring 1-3 and the stop ring 1-4 are arranged on an inner wall of the lower section 1-2. The mouthpiece 7 is detachably connected to the gel container 2.

Preferably, a lower end surface of each of the holding portions 2-2-1 in contact with the gelled e-liquid stick 8 is provided with a heating plate 2-2-2. The heating plate 2-2-2 is provided on the lower end surface of the holder 2-2 by snapping, inserting, or other means. The heating plate 2-2-2 is connected to the control board and the battery through a heating pin.

Preferably, the holding portions 2-2-1 each serve as the heating plate 2-2-2, and the lower end surface of each of the holding portions 2-2-1 in contact with the gelled e-liquid stick 8 is printed with a heating coating or a heating circuit track.

The lower end surface of each of the holding portions 2-2-1 is an end surface facing a central axis of the e-cigarette.

Preferably, an inner wall of the holder 2-2 is provided with the heating plate 2-2-2. The shape of the heating plate 2-2-2 is matched with the inner wall of the holder 2-2. The heating plate 2-2-2 may also be provided by snapping, inserting, or other means. In this case, the heating plate 2-2-2 heats the gelled e-liquid stick 8 in the holder 2-2 by radiation.

Preferably, the holder 2-2 has four symmetrically arranged holding portions 2-2-1. The center of the four symmetrically arranged holding portions 2-2-1 forms a containing chamber for the gelled e-liquid stick. Each of the holding portions 2-2-1 has a rectangular or fan-shaped cross-section for holding a rectangular or cylindrical gelled e-liquid stick 8. Alternatively, the lower end surface of each of the holding portions 2-2-1 is provided with a heating plate 2-2-2, and the heating plate 2-2-2 is an arc-shaped or rectangular heating plate, which is fully fitted with the lower end surface of the holding portion 2-2-1.

The heating plate 2-2-2 may be any heating plate applicable to the existing electric heating smoking device, such as a ceramic plate printed with a heating track. The heating track is connected to the control board and the battery of the smoking device through a heating pin.

Preferably, the mouthpiece 7 is T-shaped and provided therein with a T-shaped channel, and the aerosol channel 6 includes the gap between the upper housing 1 and the gel container 2.

Preferably, the side wall of the holder 2-2 is provided with a through hole from which aerosol produced by the atomization of the gelled e-liquid stick 8 enters the aerosol channel 6.

The side wall of the holder 2-2 may not be provided with the through hole, and the aerosol produced by the atomization of the gelled e-liquid stick 8 enters the aerosol channel 6 from an opening at a lower end of the holder 2-2.

The lower end of the holder 2-2 is close to the lower end of the smoking device. Even if the gelled e-liquid stick 8 falls to the bottommost part of the smoking device, the length of the gelled e-liquid stick exposed by the holder 2-2 is very small, thereby avoiding waste of the gelled e-liquid stick 8.

In the present disclosure, when one gelled e-liquid stick 8 is used up and a new one needs to be inserted, the new gelled e-liquid stick can be inserted by the following two methods according to the specific structure of the e-cigarette:

method 1: disassembling the upper section 1-1 from the lower section 1-2, disassembling the mouthpiece 7 from the gel container 2, putting the new gelled e-liquid stick 8 into the gel container 2 from the upper end of the gel container, and assembling the mouthpiece 7 and the upper section 1-1 as designed; and method 2: disassembling the lower housing 5 from the upper housing 1, pressing the holder 2-2 to release it, and inserting a new gelled e-liquid stick 8 from the lower end of the holder 2-2.

In the present disclosure, in an axial direction of the e-cigarette, an end of the e-cigarette close to the lip is denoted as an "upper end", and an end thereof far away from the lip is denoted as a "lower end" or "bottom end".

A second aspect of the present disclosure provides a method of using the e-cigarette described in the first aspect.

The method includes pressing the press and reset mechanism to drive the gel container 2 to move downward, such that the gradual extension structure is released from the stop ring 1-4 and a part of the gelled e-liquid stick 8 held by the gradual extension structure falls to a lower end of the holder 2-2; releasing the press and reset mechanism, such that the press and reset mechanism is reset to drive the gel container 2 to move upward, where when the holder 2-2 moves upward and is in contact with the stop ring 1-4, the holder tightens to hold the gelled e-liquid stick 8; and starting a heating program of the smoking device, such that the holder 2-2 heats the gelled e-liquid stick 8 therein, and the aerosol produced by the gelled e-liquid stick 8 enters the aerosol channel 6 for a user to inhale.

All the heating plates 2-2-2 can be heated at the same time or the heating process can be started step by step. For example, the heating plate 2-2-2 on the lower end surface of each of the holding portions 2-2-1 is first started, and then the heating plate 2-2-2 provided on the inner wall of the holder 2-2 is started to heat the gelled e-liquid stick 8 in sections.

The heating plate 2-2-2 on the lower end surface of each of the holding portions 2-2-1 can also be started separately to heat the gelled e-liquid stick 8 in sections.

In a preferred technical solution, another e-cigarette of the present disclosure has the following structure.

The e-cigarette includes an upper housing 1, a lower housing 5, a gel container 2, a press and reset mechanism, and an aerosol channel 6.

An inner wall of the upper housing 1 has an upper end provided with a limit ring 1-3 and a lower end provided with a stop ring 1-4.

The gel container 2 is a hollow cylinder, which has a lower end provided with a hollow holder 2-2, and the holder 2-2 is provided with a gradual extension structure at a connecting position between the holder 2-2 and the gel container 2.

The side wall of the holder 2-2 is longitudinally provided with multiple gaps, which divide the side wall of the holder 2-2 into multiple holding portions 2-2-1. The holding portions each are provided with multiple longitudinally spaced heating plates 2-2-2. The gradual extension structure of the holder 2-2 is in movable contact with the stop ring 1-4.

The press and reset mechanism is connected to the gel container 2 and partially protrudes outside the upper housing 1.

The heating plates 2-2-2 protrude radially from an inner wall of the holding portion 2-2-1.

A lower end surface of the heating plate 2-2-2 is provided with a heating coating or printed with a heating track. The heating plate 2-2-2 is connected to the control board and the battery through a heating pin. The lower end surface of the heating plate 2-2-2 is an end surface facing the central axis of the e-cigarette.

The lower end surface of the heating plate 2-2-2 is in contact with the gelled e-liquid stick 8, which plays the role of holding and heating.

There may be 2 to 6 holding portions 2-2-1 and 2 to 6 heating plates 2-2-2 on each of the holding portions 2-2-1, and the heating plates 2-2-2 on each of the holding portions 2-2-1 do not have contact with each other.

A method of using the e-cigarette includes pressing the press and reset mechanism to drive the gel container 2 to move downward, such that the gradual extension structure is released from the stop ring 1-4, the holder 2-2 is released, and a part of the gelled e-liquid stick 8 held by the gradual extension structure falls to a lower end of the holder 2-2; releasing the press and reset mechanism, such that the press and reset mechanism is reset to drive the gel container 2 to move upward, where when the holder 2-2 moves upward and is in contact with the stop ring 1-4, the holder tightens to hold the gelled e-liquid stick 8; and starting a heating program of the smoking device, such that the holder 2-2 heats the gelled e-liquid stick 8 therein, and the aerosol produced by the gelled e-liquid stick 8 enters the aerosol channel 6 for a user to inhale.

All the heating plates 2-2-2 can be heated at the same time or the heating process can be started step by step. For example, the heating plates 2-2-2 are started in sequence from the lower end away from the lip to the end close to the lip to heat the gelled e-liquid stick 8 in sections.

In this way, the gelled e-liquid stick falling in the inner space and lower end surface of the holder 2-2 after one press can be atomized by heating in sections. For example, four heating plates 2-2-2 at the lowermost end away from the lip are first started for the user to take two inhalations. After the user completes the two inhalations, the four lowermost heating plates are stopped, and four heating plates 2-2-2 adjacent to the four lowermost heating plates are started in sequence for the user to take two inhalations. After the user completes the two inhalations, the four heating plates adjacent to the four lowermost heating plates are stopped, and four other heating plates adjacent are started. Thus, the gelled e-liquid stick 8 can be heated and atomized consecutively, which saves electric energy and ensures a consistent amount of aerosol for each inhalation.

If the gel in the whole heating chamber is heated directly, for example, to allow the user to take 8 inhalations, the following problems will occur. Because of the large contact area between the gelled e-liquid stick and the heating element at the beginning, the atomization efficiency is high, and the amount of the aerosol for the first few inhalations is large. When the gelled e-liquid stick is partially liquefied, the contact area between the gelled e-liquid stick and the heating element decreases, and the atomization efficiency decreases, so the amount of the aerosol for the inhalations taken behind is insufficient.

The above technical solutions can be combined arbitrarily in case of no conflict.

The present disclosure has the following beneficial effects.

1. In the present disclosure, the gelled e-liquid is supplied quantitatively to the heating chamber by manually pressing the press and reset mechanism. The user can adjust the time interval between pressing and releasing the press and reset mechanism according to the needs of the user for each inhalation by adjusting the length of the gelled e-liquid stick supplied to the heating chamber. Besides, the holder 2-2 is provided with the heating plates 2-2-2, and the holder 2-2 also serves as the heating element. The design avoids the need to provide the heating element and the heating chamber separately, which reduces the volume of the smoking device.

2. The whole gelled e-liquid stick is provided in the gel container, which avoids the need for a repeated liquefaction-solidification process, so the gelled e-liquid stick used may not have the property of thermo-reversible solid-liquid phase transition. This design greatly expands the selection of materials for the gelling agent, such that some gelling agents that do not have the property of thermo-reversible solid-liquid phase transition can also be used.

3. As the gelled e-liquid stick only goes through one heating process, it does not need to go through the repeated liquefaction-solidification process. The electric energy of the heating element is maximized, and the atomization is almost not delayed, which improves the user's experience. In addition, the design avoids the chemical change of chemical substances in the gelled e-liquid stick due to repeated heating to reduce the possibility of a peculiar smell.

4. In the preferred technical solution, the upper housing 1 and the lower housing 5 are detachably or rotatably connected to facilitate the loading of the gelled e-liquid stick and cleaning of the powder residue left after the heating of gelled e-liquid stick.

5. In the preferred technical solution, the upper housing 1 is divided into the upper section 1-1 and the lower section 1-2 that are detachably connected. To load the gelled e-liquid stick, it is only necessary to disassemble the upper section 1-1 from the lower section 1-2 and put the gelled e-liquid stick into the gel container, which is convenient for operation.

6. In the preferred technical solution, multiple heating plates 2-2-2 are spaced in the holder 2-2. The multiple heating plates 2-2-2 are spaced in the axial direction of the e-cigarette, so the heating plates 2-2-2 can be started from the end far away from the lip to the end close to the lip to heat the gelled e-liquid stick 8 in sections. The design saves electric energy and ensures that the amount of the aerosol for each inhalation is consistent, avoiding the situation that the amount of the aerosol is large at the beginning and insufficient subsequently.

REFERENCE NUMERALS

Figure 1:
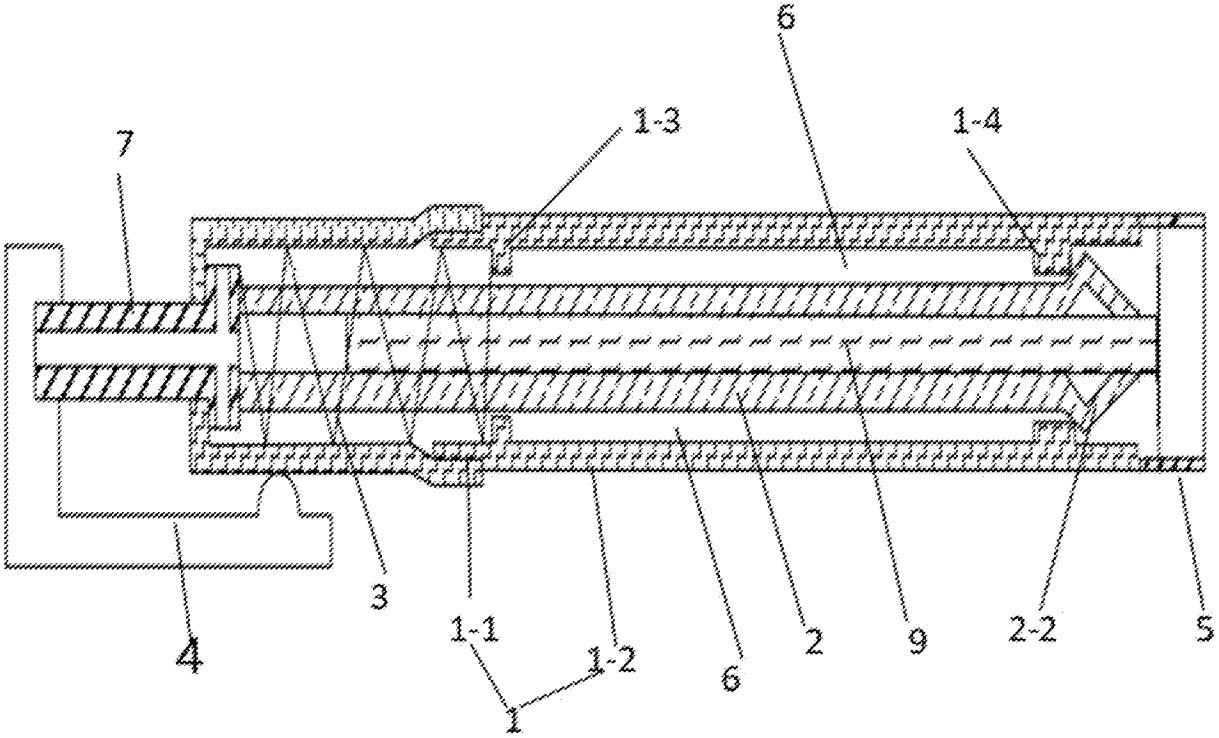
FIG. 1 is a structural diagram of an e-cigarette according to Embodiment 1 of the present disclosure.

1. upper housing; 1-1. upper section; 1-2. lower section; 1-3. limit ring; 1-4. stop ring 2. gel container; 2-2. holder; 2-2-1. holding portion; 2-2-2. heating plate; 3. reset spring; 4. press sleeve; 5. lower housing; 6. aerosol channel; 7. mouthpiece; and 8. gelled e-liquid stick.

DETAILED DESCRIPTION OF THE EMBODIMENTS

The technical solutions of the present disclosure will be further described below with reference to the specific implementations.

Embodiment 1

A preparation method for a gelled e-liquid stick includes the following steps:

1. A cigarette flavoring is prepared according to the following formula: 20% decolorized tobacco absolute, 50% peppermint oil, and 30% nicotine. These components are stirred at 300 r/min for 20 min until they are mixed well.

2. An e-liquid is prepared according to the following formula: 35% vegetable glycerin, 63% edible propylene glycol, and 2% cigarette flavoring. These components are stirred at 300 r/min for 20 min by an electric stirrer until they are mixed well. A mixture is filtered to obtain a clear e-liquid.

3. 2 parts of bone glue and 8 parts of water are mixed well in a stirring state and are gradually added to 85 parts of the e-liquid. Heating is carried out to 85° C. The temperature is held, and stirring is continued for 2 h.

4. The pH of a reaction system is adjusted to 4, and a mixture of 1 part of carrageenan and 4 parts of water is gradually added. Heating is carried out to 100° C. The temperature is held, and stirring is continued for 5 h.

5. Cooling is carried out at room temperature for 4 h to obtain the gelled e-liquid, which includes the following components by mass: 2% bone glue, 1% carrageenan, 12% water, and 85% e-liquid.

The gelled e-liquid is formed into a cylindrical gelled e-liquid stick 8 by a mold, and % denotes mass percentage.

Figure 2:
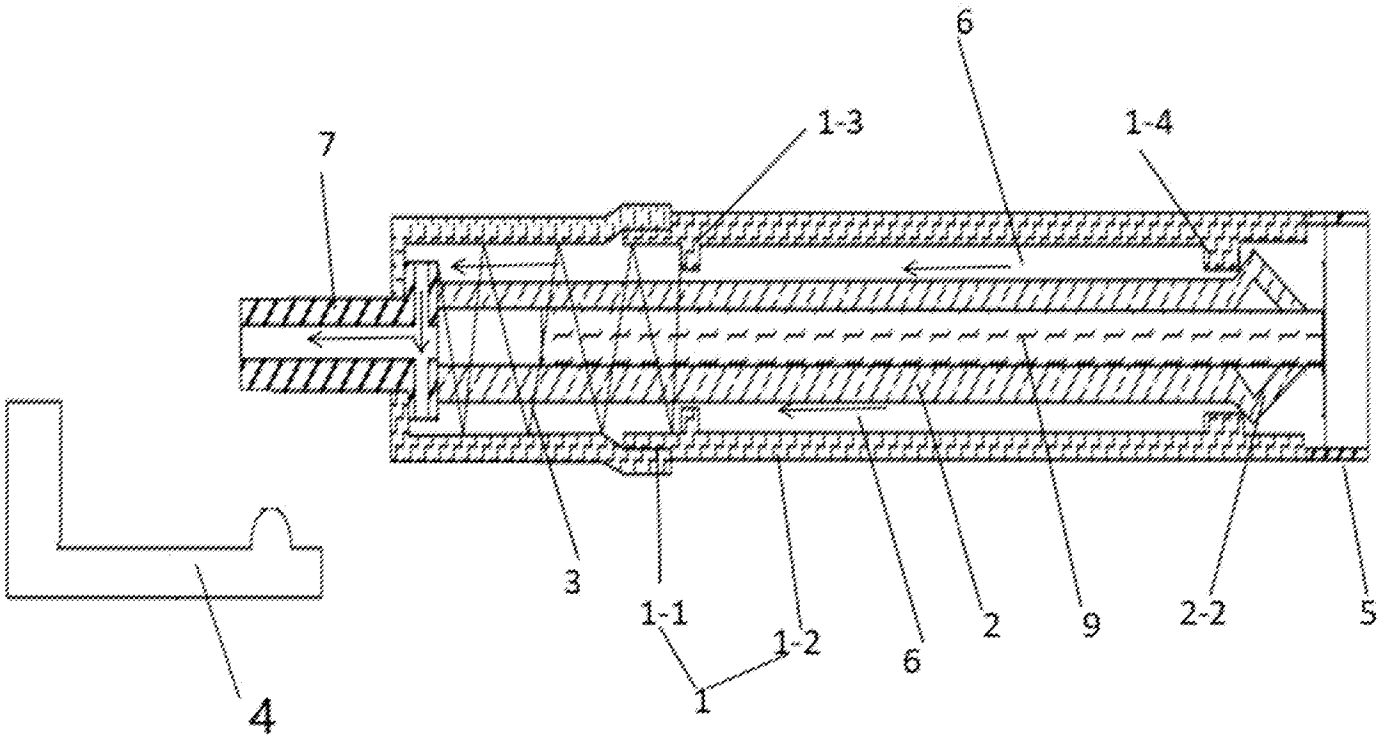
FIG. 2 is a structural diagram of the e-cigarette inhaled according to Embodiment 1 of the present disclosure.
Figure 3:
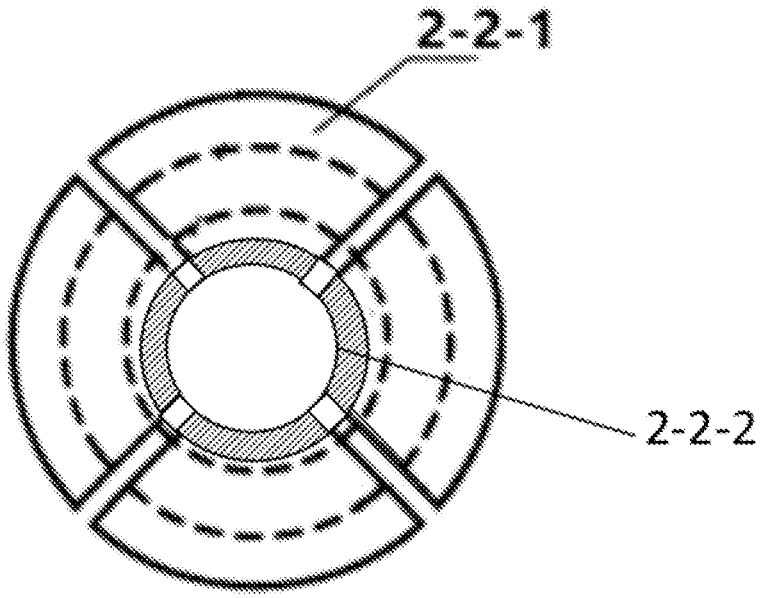
FIG. 3 is a cross-sectional diagram of a holder 2-2 of the e-cigarette according to Embodiment 1 of the present disclosure.
Figure 4:
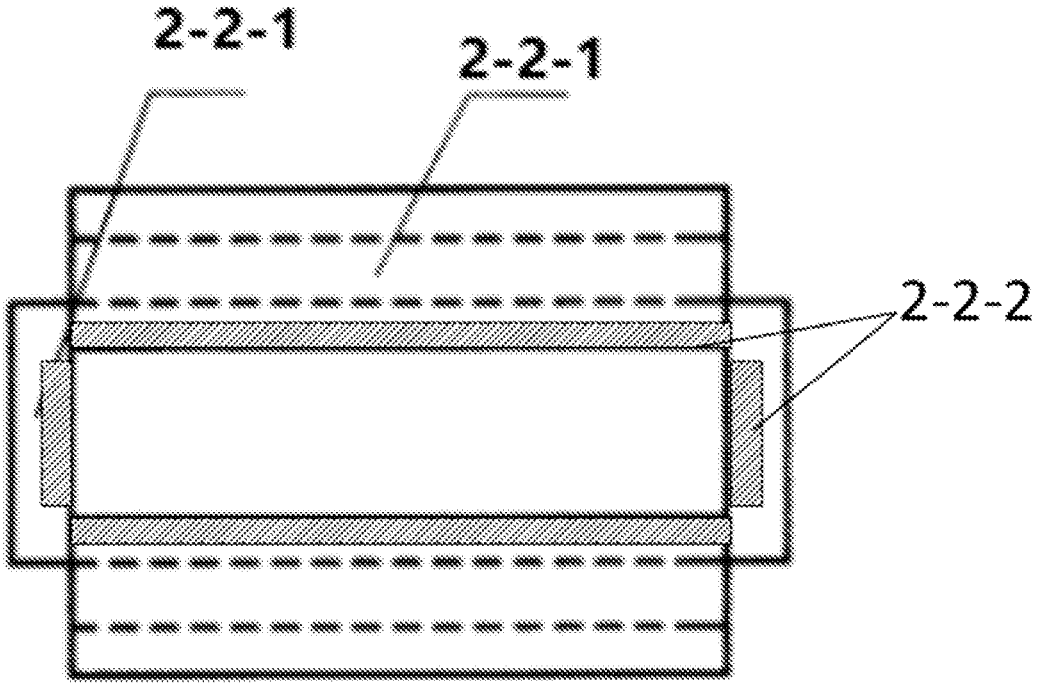
FIG. 4 is a cross-sectional diagram of a holder 2-2 of the e-cigarette according to Embodiment 2 of the present disclosure.

As shown in FIGS. 1 and 2, e-cigarette includes mouthpiece 7 detachably connected to gel container 2. Press sleeve 4 is an L-shaped press sleeve covering the mouthpiece 7. Holder 2-2 is provided with four symmetrically arranged holding portions 2-2-1, and the center of the four symmetrically arranged holding portions 2-2-1 forms a containing chamber for the gelled e-liquid stick. As shown in FIG. 3, the holding portion 2-2-1 has a fan-shaped cross-section for holding the cylindrical gelled e-liquid stick 8. A lower end surface of each holding portion 2-2-1 is provided with heating plate 2-2-2. The heating plate 2-2-2 is arc-shaped and is fully fitted with the lower end surface of the holding portion 2-2-1. The four heating plates 2-2-2 do not have contact with each other.

A method of using the e-cigarette in Embodiment 1 is as follows. The press sleeve 4 is pressed to drive the mouthpiece 7 and the gel container 2 to move downward. The holder 2-2 is released, and a part of the gelled e-liquid stick 8 held by the holder falls to the lower end of the holder 2-2. The press and reset mechanism is pressed to reset and drive the gel container 2 to move upward. When the holder 2-2 moves upward and is in contact with the stop ring 1-4, the holder tightens to hold the gelled e-liquid stick 8, as shown in FIG. 1.

The press sleeve 4 is pulled, and a heating program of the smoking device is started. When a user inhales through the mouthpiece 7, the holder 2-2 heats the gelled e-liquid stick 8 therein, and the aerosol produced by the gelled e-liquid stick 8 enters the aerosol channel 6 for the user to inhale. As shown in FIG. 2, the arrow direction denotes an aerosol direction.

A heating program of the smoking device of the e-cigarette is as follows. First, a pair of symmetrically designed heating plates 2-2-2 is heated, and two sides of the gelled e-liquid stick 8 are heated, liquefied, and atomized. Then, another pair of symmetrically designed heating plates 2-2-2 is heated, and the other two sides of the gelled e-liquid stick 8 are heated, liquefied, and atomized.

Embodiment 2

The gelled e-liquid prepared in Embodiment 1 is formed into rectangular gelled e-liquid stick 8 by a mold.

The e-cigarette of Embodiment 2 differs from the e-cigarette of Embodiment 1 as follows. The holder 2-2 is provided with four symmetrically arranged holding portions 2-2-1, and the center of the four symmetrically arranged holding portions 2-2-1 forms a containing chamber for the gelled e-liquid stick. As shown in FIG. 3, the holding portion 2-2-1 has a rectangular cross-section for holding the rectangular gelled e-liquid stick 8 of Embodiment 2. A lower end surface of each holding portion 2-2-1 is provided with heating plate 2-2-2. The heating plate 2-2-2 is a rectangular solid and is fully fitted with the lower end surface of the holding portion 2-2-1.

Embodiment 3

A preparation method for a gelled e-liquid stick includes the following steps:

1. A cigarette flavoring is prepared according to the following formula: 20% decolorized tobacco absolute, 50% peppermint oil, and 30% nicotine. These components are stirred at 300 r/min for 20 min until they are mixed well.

2. An e-liquid is prepared according to the following formula: 35% vegetable glycerin, 63% edible propylene glycol, and 2% cigarette flavoring. These components are stirred at 300 r/min for 20 min by an electric stirrer until they are mixed well. A mixture is filtered to obtain a clear e-liquid.

3. 2 parts of bone glue and 8 parts of water are mixed well in a stirring state and are gradually added to 85 parts of the e-liquid. Heating is carried out to 85° C. The temperature is held, and stirring is continued for 2 h.

4. The pH of a reaction system is adjusted to 4, and a mixture of 1 part of carrageenan and 4 parts of water is gradually added. Heating is carried out to 100° C. The temperature is held, and stirring is continued for 5 h.

5. Cooling is carried out at room temperature for 4 h to obtain the gelled e-liquid, which includes the following components by mass: 2% bone glue, 1% carrageenan, 12% water, and 85% e-liquid.

The gelled e-liquid is formed into a cylindrical gelled e-liquid stick 8 by a mold, and % denotes mass percentage.

Figure 5:
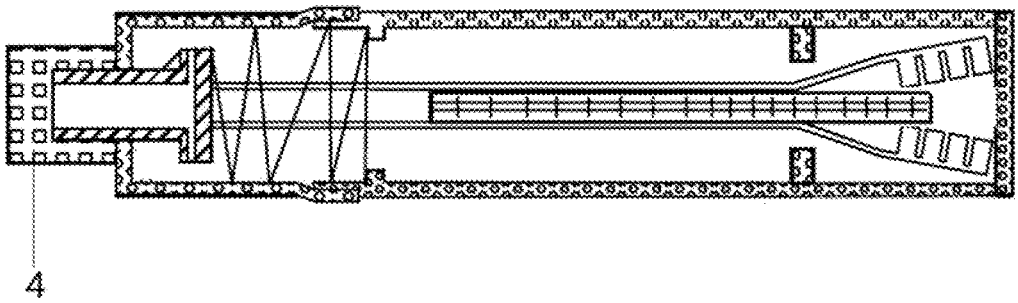
FIG. 5 is a structural diagram of the e-cigarette pressed according to Embodiment 3 of the present disclosure.
Figure 6:
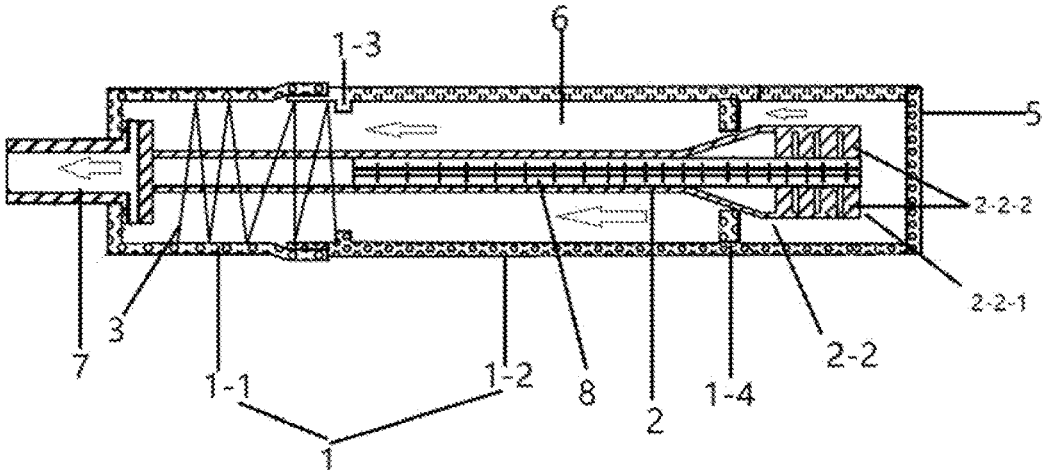
FIG. 6 is a structural diagram of the e-cigarette inhaled according to Embodiment 3 of the present disclosure.
Figure 7:
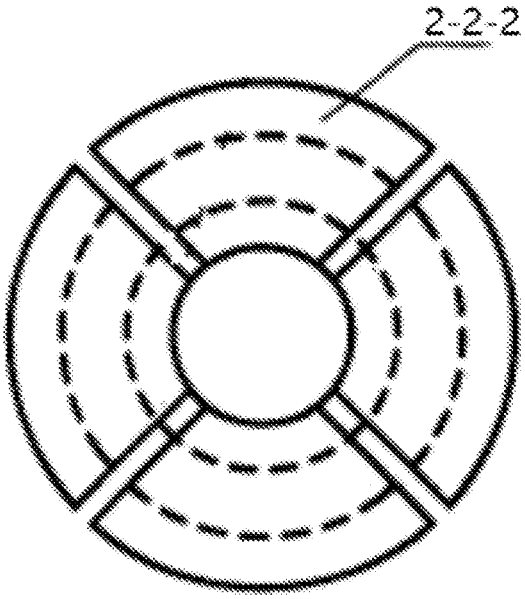
FIG. 7 is a cross-sectional diagram of a holder 2-2 of the e-cigarette according to Embodiment 3 of the present disclosure.

As shown in FIGS. 5 and 6, an e-cigarette includes mouthpiece 7 detachably connected to gel container 2. Press sleeve 4 is an L-shaped press sleeve covering the mouthpiece 7. Holder 2-2 is provided with four symmetrically arranged holding portions, and the holding portions 2-2-1 each are provided with four longitudinally spaced heating plates 2-2-2. As shown in FIG. 7, the lower end surface of the heating plate 2-2-2 in contact with the gelled e-liquid stick 8 is a fan-shaped surface for holding the cylindrical gelled e-liquid stick 8. All the heating plates 2-2-2 do not have contact with each other.

Figure 9:
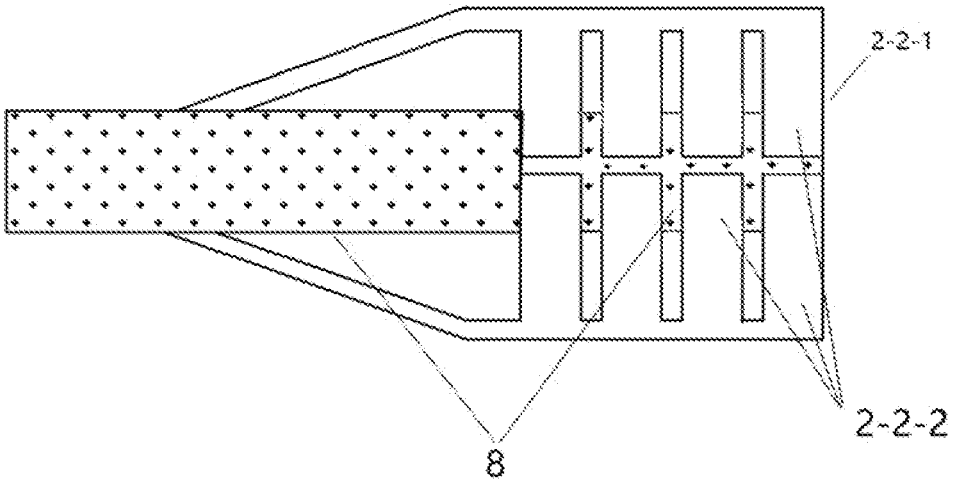
FIG. 9 is an external view of heating plates 2-2-2 of the e-cigarette holding a gelled e-liquid stick 8 according to Embodiment 3.

FIG. 9 is an external view of the heating plates 2-2-2 of the e-cigarette which holds the gelled e-liquid stick 8 according to Embodiment 3. The four heating plates 2-2-2 basically surround an outer surface of the gelled e-liquid stick 8.

A method of using the e-cigarette in Embodiment 3 is as follows. The press sleeve 4 is pressed to drive the mouthpiece 7 and the gel container 2 to move downward. The holder 2-2 is released, and a part of the gelled e-liquid stick 8 held by the holder falls to the lower end of the holder 2-2. As shown in FIG. 5, the press and reset mechanism is pressed to reset and drive the gel container 2 to move upward. When the holder 2-2 moves upward and is in contact with the stop ring 1-4, the holder tightens to hold the gelled e-liquid stick 8.

The press sleeve 4 is pulled, and a heating program of the smoking device is started. When a user inhales through the mouthpiece 7, the holder 2-2 heats the gelled e-liquid stick 8 therein from an end away from the lip to an end close to the lip, and the aerosol produced by the gelled e-liquid stick 8 enters the aerosol channel 6 for the user to inhale. As shown in FIG. 6, the arrow direction denotes an aerosol direction.

Embodiment 4

The gelled e-liquid prepared in Embodiment 3 is formed into rectangular gelled e-liquid stick 8 by a mold.

Figure 8:
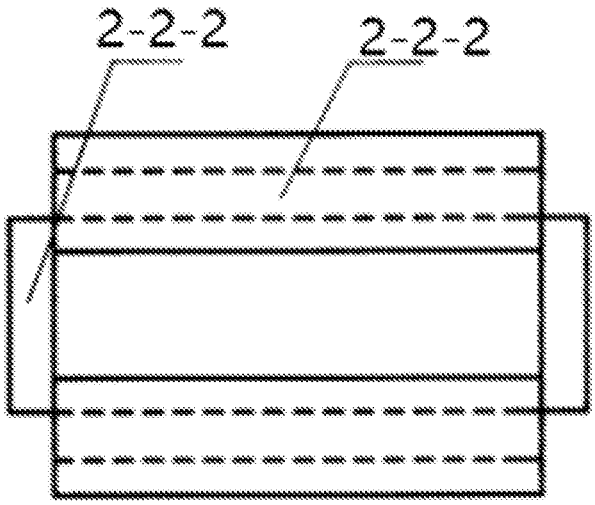
FIG. 8 is a cross-sectional diagram of a holder 2-2 of the e-cigarette according to Embodiment 4 of the present disclosure.

The e-cigarette of Embodiment 4 differs from the e-cigarette of Embodiment 3 as follows. The lower end surface of the heating plate 2-2-2 in contact with the gelled e-liquid stick 8 is rectangular for holding the rectangular gelled e-liquid stick 8 of Embodiment 4, as shown in FIG. 8.

The above described are merely specific implementations of the present disclosure, and the protection scope of the present disclosure is not limited thereto. Any modification or replacement easily conceived by those skilled in the art within the technical scope of the present disclosure should fall within the protection scope of the present disclosure. Therefore, the protection scope of the present disclosure should be subject to the protection scope of the claims.

What is claimed is:

1. An electronic cigarette (e-cigarette) capable of holding, heating, and quantitatively supplying a gelled electronic liquid (e-liquid), comprising an upper housing, a lower housing, a gel container, a press and reset mechanism, and an aerosol channel, wherein an inner wall of the upper housing has an upper end provided with a limit ring and a lower end provided with a stop ring;

the gel container is a hollow cylinder, and a lower end of the gel container is provided with a hollow holder; and a connecting position between the hollow holder and the gel container is a gradual extension structure;

a side wall of the hollow holder is longitudinally provided with a plurality of gaps, and the plurality of gaps divide the side wall of the hollow holder into a plurality of holding portions; the gradual extension structure of the hollow holder is in movable contact with the stop ring; and each of the plurality of holding portions is also a heating element;

the press and reset mechanism is connected to the gel container, and a part of the press and reset mechanism protrudes outside the upper housing;

the plurality of holding portions are provided with a plurality of longitudinally spaced heating plates; and wherein the press and reset mechanism comprises a press sleeve, a mouthpiece, and a reset spring;

wherein the press sleeve is inserted into an upper end of the mouthpiece;

the mouthpiece is clamped into the upper housing and protrudes from the upper housing, and the mouthpiece is connected to the gel container and in communication with the aerosol channel; and the reset spring is sleeved outside the gel container and has an upper end abutted against the mouthpiece and a lower end abutted against the limit ring.

2. The e-cigarette according to claim 1, wherein the upper housing comprises an upper section and a lower section, and the upper section is detachably connected to the lower section; the limit ring and the stop ring are arranged on an inner wall of the lower section; and the mouthpiece is detachably connected to the gel container.

3. The e-cigarette according to claim 1, wherein the mouthpiece is T-shaped, and a T-shaped channel is provided in the mouthpiece; and the aerosol channel comprises a gap between the upper housing and the gel container; and the side wall of the hollow holder is provided with a through hole.

4. A method of using the e-cigarette according to claim 1, comprising: pressing the press and reset mechanism to drive the gel container to move downward, so the gradual extension structure is released from the stop ring and a part of a gelled e-liquid stick held by the gradual extension structure falls to a lower end of the hollow holder; releasing the press and reset mechanism, so the press and reset mechanism is reset to drive the gel container to move upward, wherein when the hollow holder moves upward and contacts with the stop ring, the hollow holder tightens to hold the gelled e-liquid stick; and starting a heating process of a smoking device, so the hollow holder heats the gelled e-liquid stick in the hollow holder, and an aerosol produced by the gelled e-liquid stick enters the aerosol channel for a user to inhale.

5. The method according to claim 4, wherein in the e-cigarette, the upper housing comprises an upper section and a lower section, and the upper section is detachably connected to the lower section; the limit ring and the stop ring are arranged on an inner wall of the lower section; and the mouthpiece is detachably connected to the gel container.

6. The method according to claim 4, wherein in the e-cigarette, the mouthpiece is T-shaped, and a T-shaped channel is provided in the mouthpiece; and the aerosol channel comprises a gap between the upper housing and the gel container; and the side wall of the hollow holder is provided with a through hole.

* * * * *